United States Patent [19]

Miller et al.

[11] Patent Number: 5,056,222

[45] Date of Patent: Oct. 15, 1991

[54] SHAVING SYSTEM

[75] Inventors: Gary R. Miller, Tewksbury; Chester F. Jacobson, Southboro; Robert A. Trotta, Pembroke, all of Mass.

[73] Assignee: The Gillette Company, Boston, Mass.

[21] Appl. No.: 589,989

[22] Filed: Sep. 28, 1990

[51] Int. Cl.[5] ..... B26B 21/14

[52] U.S. Cl. ..... 30/77; 30/41; 30/47; 30/90

[58] Field of Search ..... 30/77, 41, 47, 50, 70, 30/90, 34.2

[56] References Cited

U.S. PATENT DOCUMENTS

| | | | |
|---|---|---|---|
| D. 290,050 | 5/1987 | Jacobson | D28/47 |
| 3,500,539 | 3/1970 | Muros | 30/63 |
| 3,648,366 | 3/1972 | Harris | 30/41 |
| 3,722,090 | 3/1973 | Dawidowicz | 30/34.2 |
| 3,768,161 | 10/1973 | Miller | 30/41 |
| 3,969,817 | 7/1976 | DiBuono | 30/41 |
| 4,170,821 | 10/1979 | Booth | 30/41 |
| 4,238,882 | 12/1980 | Harrison | 30/41 |
| 4,407,067 | 10/1983 | Trotta | 30/77 |
| 4,498,235 | 2/1985 | Jacobson | 30/47 |
| 4,535,537 | 8/1985 | Ferraro et al. | 30/41 |
| 4,573,266 | 3/1986 | Jacobson | 30/41 |
| 4,586,255 | 5/1986 | Jacobson | 30/41 |
| 4,621,424 | 11/1986 | Jacobson | 30/41 |
| 4,624,051 | 11/1986 | Apprille, Jr. et al. | 30/41 |
| 4,692,986 | 9/1987 | Motta et al. | 30/90 |
| 4,709,476 | 12/1987 | Shurtleff et al. | 30/41 |
| 4,777,722 | 10/1988 | Trotta | 30/77 |
| 4,850,107 | 7/1989 | Valliades | 30/41 |
| 4,875,287 | 10/1989 | Creasy et al. | 30/90 |
| 4,914,817 | 4/1990 | Galligan | 30/77 |
| 4,944,090 | 7/1990 | Sumnall | 30/41 |

FOREIGN PATENT DOCUMENTS

| | | | |
|---|---|---|---|
| 66602 | 1/1957 | France | 30/41 |

*Primary Examiner*—Mark Rosenbaum
*Assistant Examiner*—Hwei-Siu Payer
*Attorney, Agent, or Firm*—Fish & Richardson

[57] ABSTRACT

A shaving system of the wet shave type includes body structure with blade structure that has a cutting edge. A housing assembly carried by the body structure adjacent the blade structure includes surface structure disposed for skin-engagement adjacent of the cutting edge, structure that defines an elongated apertured chamber extending generally parallel to the cutting edge of the blade structure, and a member of shaving aid material disposed in the housing chamber. The housing assembly also includes guide portions disposed in cooperating relation with guide structure of the body structure for dynamic guided movement of the housing assembly against the biasing structure during shaving. The housing structure apertures communicate with the shaving aid material in the chamber structure and enable shaving aid material to be released and applied through the apertures to the shaver's skin surface during the course of shaving.

31 Claims, 2 Drawing Sheets

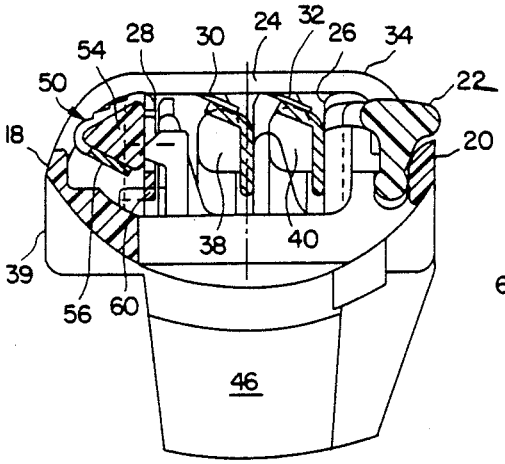
FIG. 4
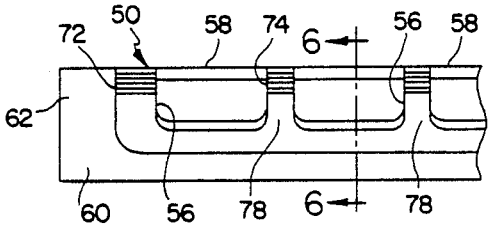
FIG. 5
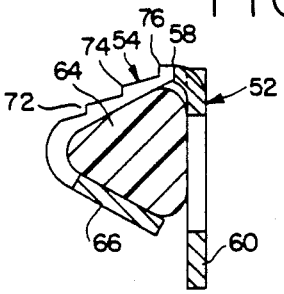
FIG. 6
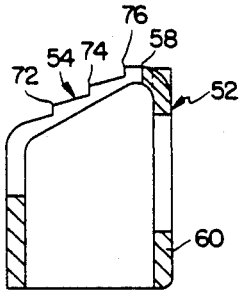
FIG. 7
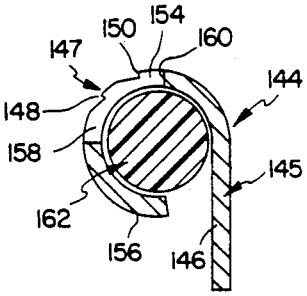
FIG. 12
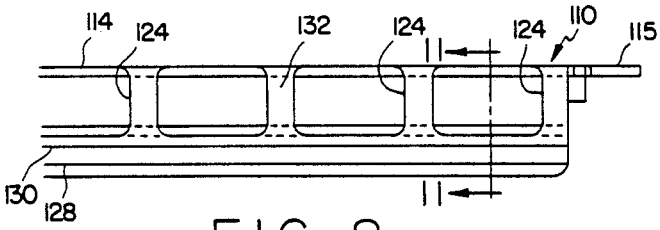
FIG. 8
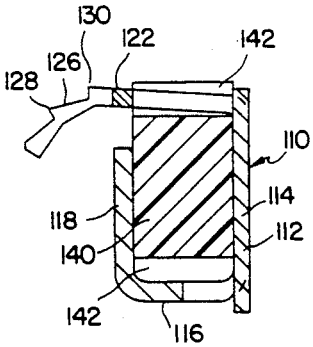
FIG. 11
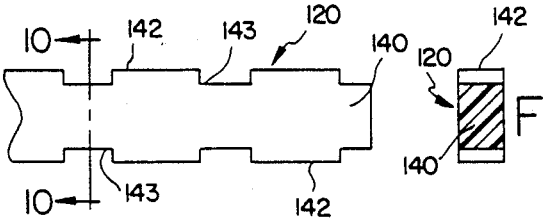
FIG. 9
FIG. 10

SHAVING SYSTEM

This invention relates to shaving systems, and more particularly to shaving systems of the wet shave type.

A shaving system of the wet shave type includes at least one blade structure and a surface for engaging the user's skin adjacent the blade edge or edges. Typically, the shaving system includes a leading skin-engaging surface (forward of the cutting edge of the blade structure) and a trailing skin-engaging surface (rearwardly of the blade unit structure). The leading skin-engaging surface may be referred to as a guard surface and the trailing skin-engaging surface may be referred to as a cap surface. The skin-engaging surface(s) cooperates with the blade edge or edges and has one or more functions such as definition of shaving geometry, tensioning of skin in the region to be shaved, and/or delivery of shaving aid material to the skin surface during the shaving stroke. The shaving system may be of the disposable cartridge type adapted for coupling to and uncoupling from a razor handle or may be integral with a handle so that the complete razor is discarded as a unit when the blade or blades become dulled.

In accordance with one aspect of the invention, there is provided a shaving system of the wet shave type that includes body structure with blade structure that has a cutting edge. A housing assembly carried by the body structure adjacent the blade structure includes surface structure disposed for skin-engagement adjacent of the cutting edge, structure that defines an elongated apertured chamber extending generally parallel to the cutting edge of the blade structure, and a member of shaving aid material disposed in the housing chamber. The housing assembly also includes guide portions disposed in cooperating relation with guide structure of the body structure for dynamic guided movement of the housing assembly against the biasing structure during shaving. The housing structure apertures communicate with the shaving aid material in the chamber structure and enable shaving aid material to be released and applied through the apertures to the shaver's skin surface during the course of shaving.

In preferred embodiments, the shaving aid material includes a mixture of water-insoluble polymeric material and water-soluble polymeric shaving aid material; the combined area of the apertures is at least fifty percent of the area of the skin-engaging surface structure; and the rear edges of the apertures provide skin tensioning surfaces.

In particular embodiments, second blade structure is mounted on the body structure for resilient movement with respect to said body structure, and supplemental shaving aid material carried by the body structure on the other side of the blade structure from the housing assembly is different from the material of the shaving aid member in the housing assembly. The housing assembly is positioned about two millimeters rearwardly of the front surface of the body structure, the cutting edge of the first blade structure is positioned about three millimeters rearwardly of that front surface; the cutting edge of the second blade structure is positioned about four millimeters rearwardly of the front surface; and the leading edge of the supplemental shaving aid material is positioned about six millimeters rearwardly of that front surface.

In particular embodiments, the member of shaving aid material may have a polygon sectional shape or a cylindrical sectional shape; and portions of the member of shaving aid material may extend through the apertures with shaving aid material surfaces in substantial alignment with the skin-engaging surface structure.

In particular embodiments, the housing assembly includes a sheet metal member, the guide portions are integral tab portions of the sheet metal member, and the guide structure in the body structure includes opposed slots in which the tab portions are disposed for guiding movement of the housing assembly along a planar predetermined path relative to the body structure. The skin-engaging surface structure include textured ridge portions and is disposed at an angle or angles between 45° and 75° to the planar predetermined path; the apertures are disposed along an axis that is perpendicular to the planar predetermined path; and the skin-engaging surface structure includes elongated web portions that are between the apertures and have longitudinal axes perpendicular to the planar predetermined path.

Other features and advantages will be seen as the following description of particular embodiments progresses in conjunction with the drawings in which:

FIG. 4 is a sectional view of the shaving system assembly of FIG. 1 taken along the line 4—4 of FIG. 2;

FIG. 5 is a front elevational view of a guard assembly incorporated in the shaving system of FIG. 1;

FIG. 6 is a sectional view taken along the line 6—6 of FIG. 5;

FIG. 7 is a vertical sectional view, similar to FIG. 6, of the metal component of the guard assembly;

FIG. 8 is a plan view of a portion of another guard assembly in for use in a shaving system in accordance with the invention;

FIG. 9 is an elevational view of a shaving member employed in the guard assembly of FIG. 8;

FIG. 10 is a sectional view taken along the line 10—10 of FIG. 9;

FIG. 11 is a sectional view taken along the line 11—11 of FIG. 8; and FIG. 12 is a sectional view of another guard assembly for use in a shaving system in accordance with the invention.

DESCRIPTION OF PARTICULAR EMBODIMENTS

Figure 1:
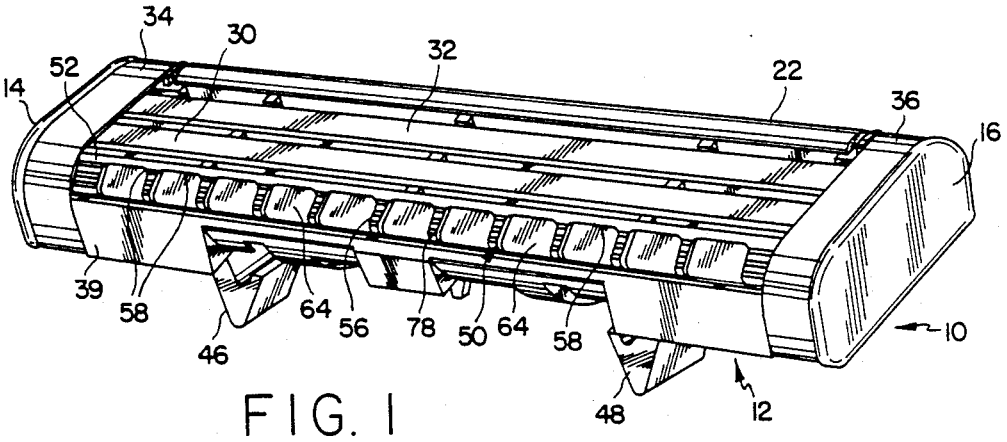
FIG. 1 is a perspective view of a shaving system in accordance with the invention.
Figure 2:
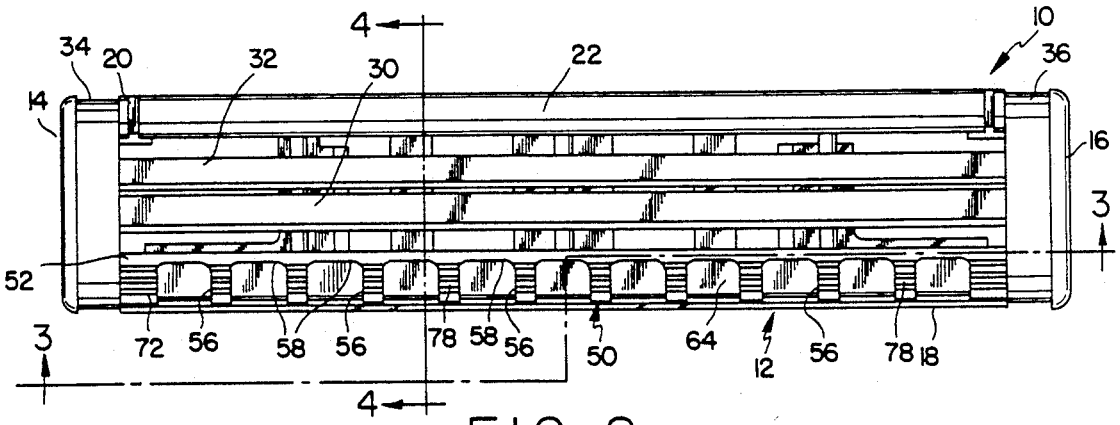
FIG. 2 is a plan view, with parts broken away, of the shaving system of FIG. 1.
Figure 3:
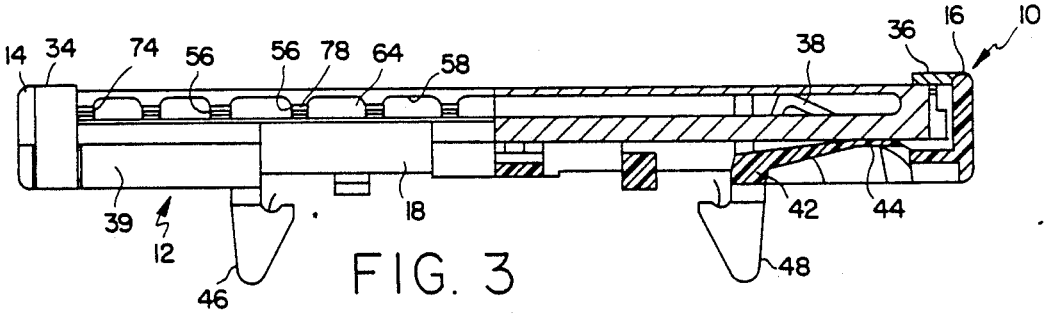
FIG. 3 is an elevational view taken along the line 3—3 of FIG. 2.

The razor blade assembly 10 shown in FIGS. 1-4 is of the type shown in Jacobson U.S. Pat. Nos. 4,498,235 and 4,586,255 (the disclosures of which are expressly incorporated herein by reference) and includes body member 12 of molded polymeric material that has end portions 14, 16 interconnecting front and rear portions 18, 20 and intermediate frame portions. Insert member 22 of shaving aid material, carried by rear portion 20, is made of a mixture of water-insoluble polymeric matrix material (polystyrene) and water-leachable shaving aid material (a mixture of polyethylene oxide and menthol). Body member 12 has a width of about eight millimeters, a height of about four millimeters, and a length of about four centimeters.

Each end portion 14, 16 has opposed slots 24, 26, 28. Slots 24 receive slide portions of leading blade unit 30 and slots 26 receive slide portions of trailing blade unit 32. Each blade unit 30, 32 is biased upwardly against metal retaining bands 34, 36 by spring fingers 38, respectively. Body member 12 also includes frame portions 42 that are provided with biasing spring fingers 44. Assembly 10 also includes depending extensions 46, 48, each of which includes an arcuate guide rail surface that engages in pivotal attachment to a razor handle (not shown).

Disposed in the region between front portion 18 and leading blade unit 30 is housing assembly 50 that includes metal housing member 52 with skin-engaging portion 54 that has spaced apertures 56, the rear edges 58 of which provide spaced skin tensioning surfaces. As indicated in FIGS. 4 and 5, housing assembly 50 has a vertical rear wall portion 60 that with portions 62 at either end that are received in guide slots 28 of end portions 14, 16. Member 64, extruded from a mixture of water-insoluble matrix material (polystyrene) and water-leachable polymeric shaving aid material (polyethylene glycol and polyethylene oxide), is secured in housing assembly 50 by tab portion 66 that seats shaving aid member 64 against planar rear wall 60 and against the inner surface of apertured skin-engaging portion 54.

Shaving member 64 is of equilateral triangular configuration and has a length of about 3.25 centimeters. Each side of the equilateral triangle, as shown in FIG. 6, has a length of about 1.3 millimeter with an apex radius of about 0.2 millimeter. Metal housing member 52 is of 0.2 millimeter thick aluminum and is formed in a progressive die to provide rear wall member 60 that has a height of about 2.6 millimeters, skin-engaging surface portion 54 that has a length of about two millimeters and is inclined at an angle of about 60° to rear wall 60 with skin tensioning ridges 72, 74, 76 on aperture defining webs 78 that are spaced about 0.5 millimeter and have a height of 0.1 millimeter; and capture tab portion 66 that has a length of about one millimeter. Apertures 56 extend from rear skin-engaging edge portion 58 (spaced about 0.3 millimeter rearwardly of ridge 76) and extend around the forward nose of triangular insert member 64. Each aperture 56 has a transverse length of about 2.4 millimeters and each ribbed intervening web 78 has a width of about 0.6 millimeter.

In manufacture, metal housing member 52 is formed to the shape indicated in FIG. 7; the triangular block 64 of shaving aid material is seated against wall surfaces of portions 54 and 60; and then capturing tab portion 66 is bent into the position shown in FIG. 7. The guide portions 62 of housing assembly 50 are positioned in slots 28 of body member 10, and biased upwardly against retaining bands 34, 36 by biasing fingers 44. Blade units 30 and 32 are similarly received in slots 24, 26 in end portions 14, 16 as indicated in FIGS. 1–4.

The resulting blade assembly is attached to a handle for shaving and the housing assembly 50 and blade units 30 and 32 move independently of each other against the bias of the spring fingers during shaving. Concurrently, the blade assembly as a whole pivots on the handle, following the contours of the skin surface being shaved. Friction enhancing surfaces 58, 72, 74, 76 tension the skin during the shaving stroke, and shaving aid materials are concurrently transferred from members 22, 64 for deposit on the skin surface being shaved.

Another housing assembly embodiment is shown in FIGS. 8–11. In that embodiment, housing assembly 110 is substituted for the housing assembly 50 of the embodiment shown in FIGS. 1–4. Housing assembly 110 includes body member 112 of 0.2 millimeter thick stainless steel that has planar back portion 114 with planar guide tabs 115 at either end; transverse portion 116 and upstanding capture portion 118 that receives rectangular member 120 of molded shaving aid material that has a width of about one millimeter and a height of about two millimeters. Housing member 112 also includes a generally horizontal portion 122 in which is formed a series of apertures 124; and cantilevered forwardly extending portion 126 which is inclined at an angle of about 75° to back portion 114 and in which are formed a series of transversely extending ridges 128, 130, each about 0.1 millimeter high and spaced about 0.3 millimeters apart. Each aperture 124 has a length of about 2.2 millimeters and intervening web portions 132 are about 0.8 millimeter wide.

Further aspects of insert member 120 may be seen with reference to FIGS. 9 and 10. As indicated in FIG. 10, member 120 has body portion 140 that is about one millimeter wide, about 1.5 millimeter high, and has a length of about 3.2 centimeters. Tab projections 142 spaced along its length have a width of about two millimeters with recesses 143 that are about one millimeter in width and about 0.3 millimeter deep. Member 120 may be molded of a polymeric material that includes a blend of water insoluble matrix material, and one or more water soluble shaving aid materials. The shaving aid material of member 120 may be different from the shaving material of insert member 22 to the rear of the blade units 28, 30. Member 120 is inserted into body member 112 with tab projections 142 extending upwardly through apertures 124 as indicated in FIG. 11 and secured in position by capture portion 118. The guide portions 115 of housing assembly 110 are positioned in slots 28 of body member 10, and biased upwardly against retaining bands 34, 36, by biasing fingers 44.

The resulting blade assembly is attached to a handle for shaving and the housing assembly 110 and blade units 28 and 30 move independently of each other against the bias of the spring fingers during shaving. Concurrently, the blade assembly as a whole pivots on the handle, following the contours of the skin surface being shaved. Friction enhancing ridge surfaces 128, 130 tension the skin during the shaving stroke, and shaving aid materials are concurrently transferred from members 22, 120 for deposit on the skin surface being shaved.

Another housing assembly embodiment is shown in FIG. 12. In that embodiment, housing assembly 144 is substituted for the housing assembly 50 of the embodiment shown in FIGS. 1–4. Metal housing member 145 is of 0.2 millimeter thick aluminum and is formed in a progressive die to provide rear wall member 146 that has a height of about 2.6 millimeters, curved skin-engaging surface portion 147 that has a length of about two millimeters with skin tensioning ridges 148, 150 on aperture defining webs 154 that are spaced about 0.5 millimeter apart and have a height of 0.1 millimeter each; and capture tab portion 156 that has a length of about one millimeter. Apertures 158 extend from rear skin-engaging edge portion 160 (spaced about 0.3 millimeter rearwardly of ridge 150) and extend around the forward portion of cylindrical insert member 162. Each elliptical aperture 158 has a transverse length of about 1.8 millimeters and each ribbed intervening web 154 has a width of about 1.2 millimeter. Cylindrical shaving aid member 162 has a length of about 3.25 centimeters and a diameter of about 1.5 millimeters. Housing assembly 144 has tab portions that are disposed in slots 28 so that surface portions 160 are located about two millimeters rearwardly of the front surface 39 of front portion 18; movable leading blade unit 32 has its guide portions received in opposed slots 24 so that its cutting edge is positioned about 2.7 millimeters rearwardly of front surface 39; trailing blade member 32 is received in slots 26 so that its cutting edge is positioned about 4.3 millimeters rearwardly of front surface 39; and member 22 of shaving aid material is carried by rear frame portion 20.

In manufacture, metal housing member 145 is formed to the shape indicated in FIG. 12; the cylindrical block 162 of shaving aid material is seated against wall surfaces of portions 146 and 147; and then capturing tab portion 156 is bent into the position shown in FIG. 12. The guide portions of housing assembly 144 are positioned in slots 28 of body member 10, and biased upwardly against retaining bands 34, 36 by biasing fingers 44. Blade units 30'' and 32'' are similarly received in slots 24, 26 in end portions 14, 16 as indicated in FIGS. 1–4.

The resulting blade assembly is attached to a handle for shaving and the housing assembly 144 and blade units 28'' and 30 move independently of each other against the bias of the spring fingers during shaving. Concurrently, the blade assembly as a whole pivots on the handle, following the contours of the skin surface being shaved. Friction enhancing ridge surfaces 148, 150, 160 tension the skin during the shaving stroke, and shaving aid materials are concurrently transferred from members 22, 162 for deposit on the skin surface being shaved.

While particular embodiments of the invention have been shown and described, various modifications may be apparent to those skilled in the art, and therefore it is not intended that the invention be limited to the disclosed embodiments or to details thereof, and departures may be made therefrom within the spirit and scope of the claims.

What is claimed is:

1. A shaving system comprising body structure that incorporates guide structure, blade structure carried by said body structure, said blade structure having a cutting edge extending along the length of said body structure, a housing assembly carried by said body structure adjacent said cutting edge of said blade structure, said housing assembly including guide portions disposed in said guide structure, skin-engaging surface structure disposed for skin-engagement adjacent said cutting edge, chamber defining structure, a wall of said chamber defining structure having apertures therein adjacent said skin-engaging surface structure, and a member of shaving aid material disposed in said chamber defining structure for transfer of shaving aid material through said apertures to the skin surface being shaved during the course of a shaving stroke, and biasing structure cooperating with said housing assembly and said body structure for dynamic movement of said housing assembly against said biasing structure as guided by said guide structure in the course of shaving.

2. The system of claim 1 wherein the rear edges of said apertures provide skin-tensioning surfaces.

3. The system of claim 1 wherein said skin-engaging surface structure is an external wall of said chamber defining structure.

4. The system of claim 1 wherein said skin-engaging surface structure is defined by a cantilever portion that extends forwardly from said chamber defining structure.

5. The system of claim 1 wherein said apertures are in said skin-engaging surface structure.

6. The shaving system of claim 1 wherein the combined area of said apertures is at least fifty percent of the area of said skin-engaging surface structure.

7. The system of claim 1 wherein said housing assembly includes a sheet metal member, said guide portions are integral tab portions of said sheet metal member, and said guide structure in said body structure includes opposed slots in which said tab portions are disposed for guiding movement of said housing assembly along a predetermined path relative to said body structure.

8. The system of claim 7 wherein said predetermined path is planar and said housing assembly is mounted for linear movement along said planar predetermined path.

9. The system of claim 8 wherein said apertures are disposed along an axis that is perpendicular to said planar predetermined path.

10. The system of claim 9 wherein said skin-engaging surface structure includes elongated web portions that are between said apertures and have longitudinal axes perpendicular to said planar predetermined path.

11. The system of claim 8 wherein said skin-engaging surface structure include textured portions and is disposed at an acute angle or angles to said planar predetermined path.

12. The system of claim 11 wherein said skin-engaging surface structure is disposed at an angle or angles between 45° and 75° to said planar predetermined path.

13. The system of claim 11 wherein said textured portions include ridges that extend along axes that are perpendicular to said planar predetermined path.

14. The system of claim 1 wherein said member of shaving aid material has a polygon sectional shape.

15. The system of claim 1 wherein said member of shaving aid material has a cylindrical sectional shape.

16. The system of claim 1 wherein portions of said member of shaving aid material extends through said apertures with surfaces of said member of shaving aid material in substantial alignment with said skin-engaging surface structure.

17. The system of claim 1 wherein said shaving aid material includes a mixture of hydrophobic polymeric material and water soluble polymeric material which is capable of forming an aqueous lubricant.

18. The system of claim 1 and further including second blade structure mounted on said body structure for resilient movement with respect to said body structure.

19. The system of claim 1 and further comprising supplemental shaving aid material carried by said body structure on the other side of said blade structure from said housing assembly.

20. The system of claim 19 wherein said supplemental shaving aid material is different from the material of said shaving aid member.

21. The system of claim 19 wherein said biasing structure includes resilient fingers that are integral with said body structure and resiliently bias said housing assembly into a predetermined position.

22. The system of claim 21 and further including second blade structure mounted on said body structure for resilient movement with respect to said body structure.

23. The system of claim 22 wherein said housing assembly includes a sheet metal member, said guide portions are integral tab portions of said sheet metal member, and said guide structure in said body structure includes opposed slots in which said tab portions are disposed for guiding movement of said housing assembly along a predetermined path relative to said body structure.

24. The system of claim 23 wherein said housing assembly is positioned about two millimeters rearwardly of the front surface of said body structure, the cutting edge of said first blade structure is positioned about three millimeters rearwardly of said front surface; the cutting edge of said second blade structure is positioned about four millimeters rearwardly of said front surface; and the leading edge of said supplemental shaving aid material is positioned about six millimeters rearwardly of said front surface.

25. The system of claim 24 wherein said apertures are in said skin-engaging surface structure.

26. The system of claim 25 wherein portions of said member of shaving aid material extends through said apertures with surfaces of said member of shaving aid material in substantial alignment with said skin-engaging surface structure.

27. The system of claim 25 wherein said shaving aid material includes a mixture of hydrophobic polymeric material and water soluble polymeric material which is capable of forming an aqueous lubricant.

28. The shaving system of claim 27 wherein the combined area of said apertures is at least fifty percent of the area of said skin-engaging surface structure.

29. The system of claim 28 wherein the rear edges of said apertures provide skin tensioning surfaces.

30. The system of claim 29 wherein said supplemental shaving aid material is different from the material of said shaving aid member.

31. The system of claim 30 wherein said skin-engaging surface structure further includes a cantilever portion that extends forwardly from said chamber defining structure.

* * * * *